US009115567B2

(12) United States Patent
Hsu et al.

(10) Patent No.: US 9,115,567 B2
(45) Date of Patent: Aug. 25, 2015

(54) METHOD AND APPARATUS FOR DETERMINING EFFICIENCY OF A SAMPLING TOOL

(71) Applicant: Schlumberger Technology Corporation, Sugar Land, TX (US)

(72) Inventors: Kai Hsu, Sugar Land, TX (US); Kent David Harms, Richmond, TX (US); Steven G. Villareal, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 343 days.

(21) Appl. No.: 13/676,766

(22) Filed: Nov. 14, 2012

(65) Prior Publication Data

US 2014/0131037 A1 May 15, 2014

(51) Int. Cl.

| | |
|---|---|
| ***E21B 47/00*** | (2012.01) |
| ***E21B 49/08*** | (2006.01) |
| ***E21B 49/10*** | (2006.01) |

(52) U.S. Cl.

CPC ..... *E21B 47/0007* (2013.01); *E21B 49/081* (2013.01)

(58) Field of Classification Search

CPC ... E21B 49/081; E21B 49/10; E21B 47/0007; F04B 2205/01; F04B 2205/05

USPC ..... 166/250.17, 264, 101, 66, 105; 73/152.24, 152.51, 152.61

See application file for complete search history.

(56) References Cited

U.S. PATENT DOCUMENTS

| | | | | |
|---|---|---|---|---|
| 5,184,507 | A * | 2/1993 | Drake | 73/152.61 |
| 5,635,631 | A * | 6/1997 | Yesudas et al. | 73/61.46 |
| 6,092,416 | A | 7/2000 | Halford et al. | |
| 6,167,965 | B1 * | 1/2001 | Bearden et al. | 166/250.15 |
| 6,467,544 | B1 | 10/2002 | Brown et al. | |
| 6,659,177 | B2 | 12/2003 | Bolze et al. | |
| 6,851,444 | B1 * | 2/2005 | Kohl et al. | 137/13 |
| 7,083,009 | B2 | 8/2006 | Paluch et al. | |
| 7,140,436 | B2 | 11/2006 | Grant et al. | |
| 7,158,887 | B2 | 1/2007 | Betancourt et al. | |
| 7,195,063 | B2 | 3/2007 | Nogueira et al. | |
| 7,198,105 | B2 | 4/2007 | Grant et al. | |
| 7,246,664 | B2 | 7/2007 | Shammi et al. | |
| 7,367,394 | B2 | 5/2008 | Villareal et al. | |
| 7,594,541 | B2 | 9/2009 | Ciglenec et al. | |
| 7,621,325 | B2 | 11/2009 | Shammi et al. | |
| 7,668,694 | B2 * | 2/2010 | Anderson et al. | 702/182 |
| 7,878,244 | B2 | 2/2011 | Nold, III et al. | |
| 8,555,968 | B2 * | 10/2013 | Zazovsky et al. | 166/264 |
| 8,672,026 | B2 * | 3/2014 | van Zuilekom et al. | 166/264 |

(Continued)

OTHER PUBLICATIONS

A. Crombie, F. Halford, G. Melbourne, M.N. Hashem, R.I. McNeil, E.C. Thomas, and O.C. Mullins, "Innovations in wireline fluid sampling," Oilfield Review, vol. 10, Issue 3, 1998.

(Continued)

*Primary Examiner* — Jennifer H Gay

(74) *Attorney, Agent, or Firm* — Cathy Hewitt; Kenneth L. Kincaid

(57) ABSTRACT

A downhole tool includes a pump to facilitate a flow of sampling fluid through the downhole tool. The sampling fluid flows from an inlet of the downhole tool toward an outlet of the downhole tool or to a sampling chamber. The downhole tool also includes a sensor located in the pump. The sensor facilitates a calculation of a pumping efficiency of the downhole tool.

17 Claims, 9 Drawing Sheets

(56) References Cited

U.S. PATENT DOCUMENTS

| | | | | |
|---|---|---|---|---|
| 8,682,589 | B2 * | 3/2014 | Thigpen et al. | 702/12 |
| 8,684,078 | B2 * | 4/2014 | Boyles et al. | 166/250.15 |
| 8,775,089 | B2 * | 7/2014 | van Zuilekom et al. | 702/11 |
| 2007/0079962 | A1 * | 4/2007 | Zazovsky et al. | 166/264 |
| 2007/0289740 | A1 * | 12/2007 | Thigpen et al. | 166/250.01 |
| 2008/0067116 | A1 * | 3/2008 | Anderson et al. | 210/100 |
| 2008/0245569 | A1 * | 10/2008 | Nold et al. | 175/24 |
| 2009/0044938 | A1 * | 2/2009 | Crossley et al. | 166/250.15 |
| 2011/0048700 | A1 * | 3/2011 | van Zuilekom et al. | 166/250.01 |
| 2012/0018152 | A1 * | 1/2012 | Zuilekom et al. | 166/264 |
| 2013/0133881 | A1 * | 5/2013 | Boyles et al. | 166/250.01 |
| 2014/0131037 | A1 * | 5/2014 | Hsu et al. | 166/264 |
| 2014/0352953 | A1 * | 12/2014 | Gao et al. | 166/250.15 |

OTHER PUBLICATIONS

S. Villareal, J. Pop SPE, F. Bernard, K. Harms, A. Hoefel, A Kamiya, P. Swinburne and S. Ramshaw, "Characterization of Sampling While Drilling Operations," SPE 128249, IADC/SPE Drilling Conference and Exhibition, Feb. 2-4, 2010, New Orleans, Louisiana, USA.

C. Meyers, S. Vera and S. Haq, "Operational Considerations for Openhole Wireline Formation Tester Sampling in a Prolific Gas Reservoir," 10624-MS, International Petroleum Technology Conference, Nov. 2005, Doha, Qatar.

* cited by examiner

METHOD AND APPARATUS FOR DETERMINING EFFICIENCY OF A SAMPLING TOOL

BACKGROUND

The present disclosure relates generally to drilling systems and more particularly to downhole tools for sampling formation fluid.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Wells are generally drilled into a surface (land-based) location or ocean bed to recover natural deposits of oil and gas, as well as other natural resources that are trapped in geological formations in the Earth's crust. A well is often drilled using a drill bit attached to the lower end of a "drill string," which includes drillpipe, a bottom hole assembly, and other components that facilitate turning the drill bit to create a borehole. Drilling fluid, or "mud," is pumped down through the drill string to the drill bit during a drilling operation. The drilling fluid lubricates and cools the drill bit, and it carries drill cuttings back to the surface in an annulus between the drill string and the borehole wall.

For successful oil and gas exploration, it is desirable to have information about the subsurface formations that are penetrated by a borehole. For example, one aspect of standard formation evaluation relates to measurements of the formation pressure, formation permeability and the recovery of formation fluid samples. These measurements may be useful for predicting the economic value, the production capacity, and production lifetime of a subsurface formation. Formation fluid samples may be extracted from the well and evaluated in a laboratory to establish physical and chemical properties of the formation fluid. Such evaluation may include analyses of fluid viscosity, density, composition, gas/oil ratio (GOR), differential vaporization, PVT analysis, multi-stage separation tests, and so forth. Recovery of formation fluid samples, in order to perform such evaluations, may be accomplished using different types of downhole tools, which may be referred to as formation testers. Formation testing tools may use pumps to withdraw fluid from a formation for analysis within the tool or storing the fluid in a sample chamber for later analysis.

It is now recognized that, under certain conditions, formation testing tools may encounter difficulty in efficiently recovering formation fluid samples. For example, when the sampled formation fluid is highly compressible, a formation testing tool may expend available pumping energy just to compress and decompress the fluid sample in the tool, instead of moving the fluid sample through the tool. Therefore, there is a need for improved downhole formation testing tools and improved techniques for operating and controlling such tools so that such downhole formation testing tools are more reliable, efficient, and adaptable to various formation, borehole, and mud circulation conditions.

SUMMARY

In a first embodiment, a downhole tool includes a pump to facilitate a flow of sampling fluid through the downhole tool. The sampling fluid flows from an inlet of the downhole tool toward an outlet of the downhole tool or to a sampling chamber. The downhole tool also includes a sensor located in the pump. The sensor facilitates a calculation of a pumping efficiency of the downhole tool.

In another embodiment, a system includes a downhole tool with a sensor. The downhole tool may receive sampling fluid from a well formation. The system also includes a processor designed to receive a signal from the sensor and to determine, based on the signal, an efficiency of the downhole tool in facilitating the flow of sampling fluid through the downhole tool. The signal may indicate a pressure, temperature, flow rate, torque, rotational speed, or current.

In a further embodiment, a method includes receiving, via a processor, a signal from a sensor. The signal may indicate a sensed parameter of a downhole tool. The downhole tool may receive and collect samples of the sampling fluid. The method also includes determining, via the processor, an efficiency of the downhole tool in facilitating the flow of sampling fluid through the downhole tool based on the received signal.

Various refinements of the features noted above may exist in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. Again, the brief summary presented above is intended only to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings in which.

DETAILED DESCRIPTION

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

Present embodiments are directed to systems and methods for quantifying an efficiency of sample fluid movement through a downhole tool. A processor may determine this efficiency based on feedback from one or more sensors located in the downhole tool. The processor may be contained within the downhole tool and coupled to control circuitry for adjusting pump operation of the tool based on the calculated efficiency. The sensor(s) may be located in the pump (e.g., in fluid chambers of the pump) that moves the formation fluid through the tool. In some embodiments, there may be two sensors, one located upstream of the pump to facilitate calculation of an in-stroke efficiency during continuous pumping operation, and one located downstream of the pump to facilitate calculation of an out-stroke efficiency during continuous pumping operation. There may be one or more sensors located in sample bottles used to collect the fluid samples, or in a flowline adjacent the sample bottles, to facilitate calculation of a sampling efficiency of the downhole tool. A sensor used for such efficiency calculations may include a flow meter, a thermometer, a pressure gauge, a torque sensor, a rotational speed sensor (e.g., resolver), or a current sensor.

Figure 1:
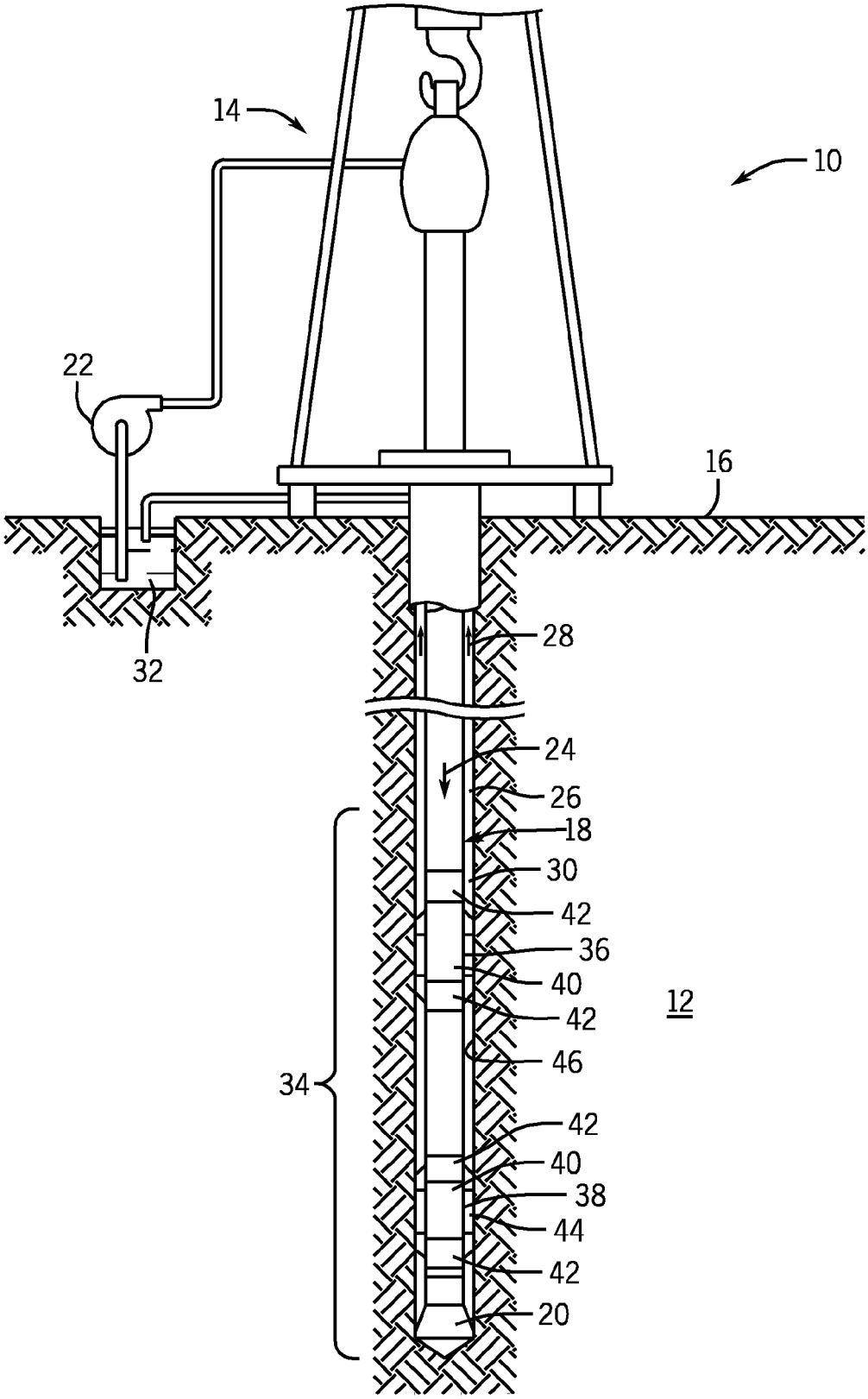
FIG. 1 is a partial cross sectional view of a drilling system used to drill a well through subsurface formations, in accordance with an embodiment of the present techniques.

FIG. 1 illustrates a drilling system 10 used to drill a well through subsurface formations 12. A drilling rig 14 at the surface 16 is used to rotate a drill string 18 that includes a drill bit 20 at its lower end. As the drill bit 20 is rotated, a "mud" pump 22 is used to pump drilling fluid, commonly referred to as "mud" or "drilling mud," downward through the center of the drill string 18 in the direction of the arrow 24 to the drill bit 20. The mud, which is used to cool and lubricate the drill bit 20, exits the drill string 18 through ports (not shown) in the drill bit 20. The mud then carries drill cuttings away from the bottom of a borehole 26 as it flows back to the surface 16, as shown by the arrows 28 through an annulus 30 between the drill string 18 and the formation 12. At the surface 16, the return mud is filtered and conveyed back to a mud pit 32 for reuse.

While a drill string 18 is illustrated in FIG. 1, it will be understood that the embodiments described herein are applicable to work strings and wireline tools as well. Work strings may include a length of tubing (e.g. coil tubing) lowered into the well for conveying well treatments or well servicing equipment. Wireline tools may include formation testing tools suspended from a multi-wire cable as the cable is lowered into a well so that it can measured formation properties at desired depths. It should be noted that the location and environment of the well may vary widely depending on the formation 12 into which it is drilled. Instead of being a surface operation, for example, the well may be formed under water of varying depths, such as on an ocean bottom surface. Certain components of the drilling system 10 may be specially adapted for underwater wells in such instances.

As illustrated in FIG. 1, the lower end of the drill string 18 includes a bottom-hole assembly ("BHA") 34 that includes the drill bit 20, as well as a plurality of drill collars 36, 38. The drill collars 36, 38 that may include various instruments, such as sample-while-drilling ("SWD") tools that include sensors, telemetry equipment, and so forth. For example, the drill collars 36, 38 may include logging-while-drilling ("LWD") modules 40 and/or measurement-while drilling ("MWD") modules 42. The LWD modules or tools 40 may include tools configured to measure formation parameters or properties, such as resistivity, porosity, permeability, sonic velocity, and so forth. The MWD modules or tools 42 may include tools configured to measure wellbore trajectory, borehole temperature, borehole pressure, and so forth. The LWD modules 40 of FIG. 1 are each housed in one of the drill collars 36, 38, and each contain any number of logging tools and/or fluid sampling devices. The LWD modules 40 include capabilities for measuring, processing and/or storing information, as well as for communicating with the MWD modules 42 and/or directly with the surface equipment such as, for example, a logging and control computer.

In certain embodiments, the SWD tools (e.g., LWD modules 40 and MWD modules 42) may also include or be disposed within a centralizer or stabilizer 44. In certain embodiments, the centralizer/stabilizer 44 comprises blades that are in contact with the borehole wall 46 as shown in FIG. 1 to limit "wobble" of the drill bit 20. "Wobble" is the tendency of the drill string 18, as it rotates, to deviate from the vertical axis of the borehole 26 and cause the drill bit 20 to change direction. It will be understood that a downhole tool may be disposed in locations other than in the centralizer/stabilizer 44 without departing from the scope of the presently disclosed embodiments.

Present embodiments are directed toward systems and methods for determining an efficiency of fluid sampling using a downhole tool. Such efficiency calculations may be performed by a processor located in the downhole tool, as described below. Different efficiencies (e.g., active duty-cycle pumping efficiencies, volumetric sampling efficiencies, etc.) may be determined based on sensor measurements taken from different locations throughout the downhole tool. The efficiency calculations may be utilized during sampling of any compressible fluid from the formation 12, including formation gas, gas condensate, and volatile oil, among other hydrocarbons.

Figure 2:
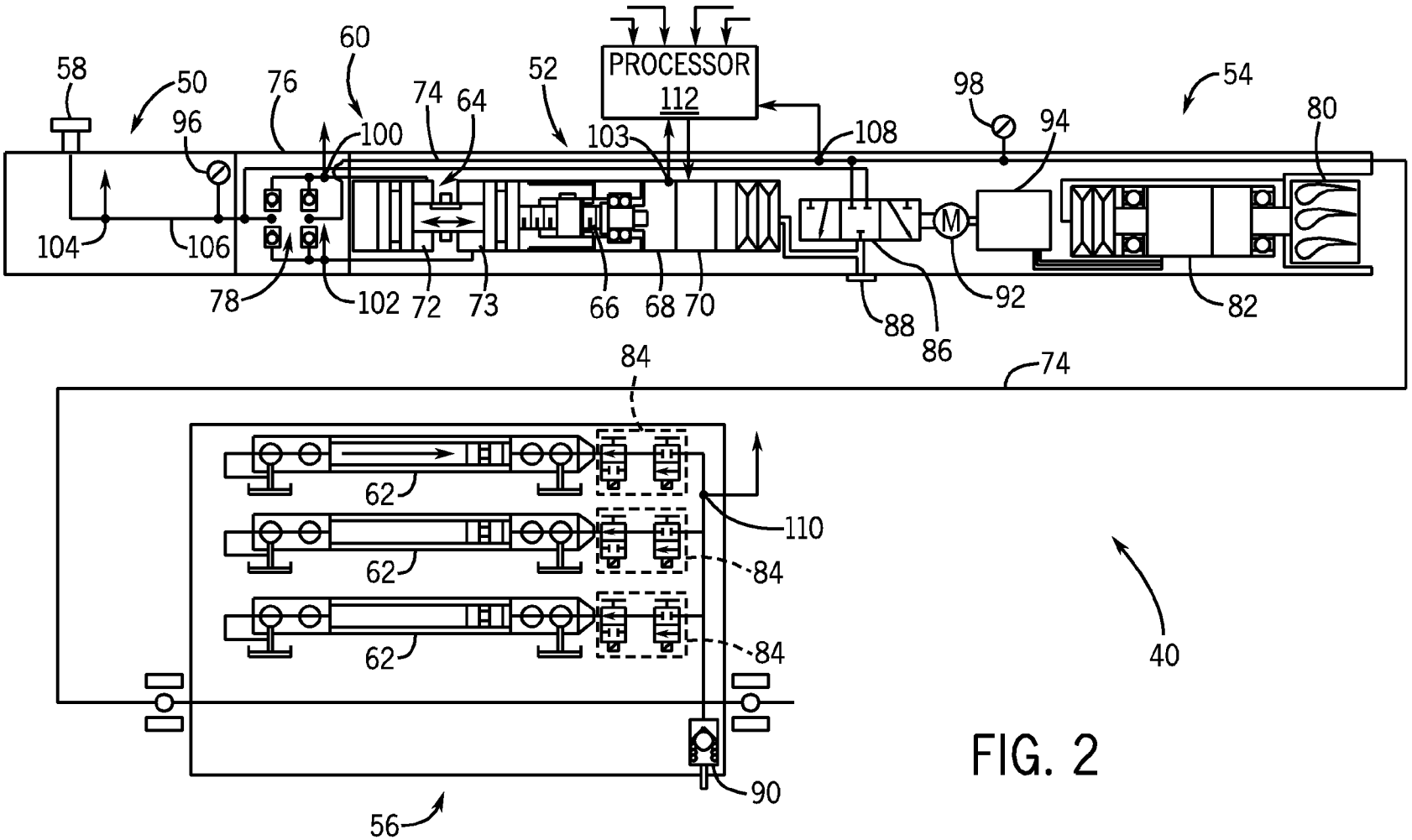
FIG. 2 is a schematic diagram of downhole equipment used to sample a subsurface formation, in accordance with an embodiment of the present techniques.

FIG. 2 is a schematic diagram of an embodiment of downhole equipment used to sample a well formation. Specifically, the illustrated downhole equipment includes an embodiment of the LWD tool 40, which may be used to collect fluid samples from the formation 12 during the drilling process. It should be noted, however, that the principles of efficiency quantification disclosed in this application are not limited to use in LWD tools 40. Indeed, such principles are applicable across a wide range of other downhole equipment (e.g., wireline tools) that may be used to sample formation fluid. In general, the sensors used to facilitate efficiency calculations are configured in a shop setting, but in some cases (e.g., in wireline tools) may be configured or customized at the rig site.

The illustrated LWD tool 40 includes a probe module 50, a pumpout module 52, a power generation module 54, and multi-sample module 56. The illustrated probe module 50 includes an extendable fluid communication line (probe 58) designed to engage the formation 12 and to communicate fluid samples from the formation 12 into the LWD tool 40. In addition to the probe 58, the probe module 50 may include electronics, batteries, sensors, and/or hydraulic components used to operate the probe 58. The pumpout module 52 includes a pump 60 used to create a pressure differential that draws the formation fluid in through the probe 58 and pushes the fluid through the LWD tool 40. The power generation module 54 provides power to the pump 60, and the multi-sample module 56 includes one or more sample bottles 62 for collecting samples of formation fluid.

The pumpout module 52 includes the pump 60, which may be an electromechanical pump, for pumping formation fluid from the probe module 50 to the multi-sample module 56 and/or out of the LWD tool 40. In the illustrated embodiment, the pump 60 operates via a piston displacement unit (DU) 64 driven by a ball screw 66 coupled to a gearbox 68 and electric motor 70. The DU 64 pushes sampled formation fluid in and out of two chambers 72, 73 of the DU 64 through flow lines. For example, as the illustrated reciprocating piston of the DU 64 moves from left to right, formation fluid is drawn into the right chamber 73 as the volume of the right chamber 73 increases. Simultaneously, the piston decreases the volume of the left chamber 72, pushing formation fluid from the left chamber 72 into a flowline 74 leading toward the multi-sample module 56. A mud check valve block 76 having multiple mud check valves 78 directs the formation fluid in and out of the chambers 72, 73 of the DU 64 as the piston moves back and forth. Although the illustrated valves (mud check valves 78) are passive check valves, other embodiments may employ valves that are actively controlled to direct the flow of formation fluid into the chambers 72, 73 of the DU 64. The mud check valves 78 allow for continuous pumping of formation fluid even as the DU 64 switches direction.

Power may be supplied to the pump 60 via the power generation module 54, which includes a dedicated mud turbine 80 coupled with an alternator 82. During a sampling period, the pump 60 moves the formation fluid through the flowline 74 toward the multi-sample module 56. Valves 84 in the multi-sample module 56 may be positioned to allow the formation fluid to flow into the sample bottles 62. In the illustrated embodiment, the valves 84 include a pair of EXO valves for each sample bottle 62, one normally closed and the other normally opened. During the sampling period, the normally closed valve may be opened, allowing the formation fluid to enter the corresponding sample bottle 62. Similarly, when the sample bottle 62 is filled, the normally opened valve may be moved to the closed position to seal the sample bottle 62. Other embodiments may include different types and/or arrangements of the valves 84, such as an actively controlled valve for each sample bottle 62.

The LWD tool 40 may include a fluid routing valve (FRV) 86 that directs the formation fluid from the flowline 74 to the annulus 30 outside of the LWD tool 40 in a first valve position or orientation of the FRV 86. In this way, the FRV 86 may facilitate removal of the formation fluid from the LWD tool 40 during a continuous pumping period of operation. The FRV 86 may direct the formation fluid through an exit port 88 to the annulus 30 outside of the LWD tool 40 when the formation fluid is not ready for sampling (as determined, for example, based on a fluid contamination level). The FRV 86 may direct the formation fluid toward the multi-sample module 56 via the flowline 74 in a second valve position or configuration of the FRV 86. In some instances, the FRV 86 may direct the fluid through the flowline 74 toward the multi-sample module 56, while the valves 84 are closed and block access to the sample bottles 62. In this case, the formation fluid may exit the LWD tool 40 via an exit port 90 of the multi-sample module 56. The FRV 86 may be placed in other valve positions for directing the formation fluid into another flowpath of the LWD tool 40. A motor 92, controlled by power electronics 94, may move the FRV 86 to different positions at different stages of pumping and sampling operation.

In addition to the pump 60, the pumpout module 52 may include a number of sensors for monitoring parameters of the sample fluid moving through the pump-out module 52. For example, the LWD tool 40 may include two pressure gauges 96 and 98: the first to monitor an inlet pressure (e.g., pressure at the probe 58 of the probe module 50), and the second to monitor an outlet pressure (e.g., pressure of fluid moving toward the multi-sample module 56). In addition, the LWD tool 40 may include sensors at various locations to measure other fluid properties or characteristics such as density, viscosity, temperature, composition, and so forth.

As previously mentioned, the LWD tool 40 may include at least one sensor that facilitates calculation of an efficiency of the LWD tool 40 in moving the formation fluid samples therethrough. The sensor may include a pressure gauge, a thermometer, a flow meter, an electrical sensor (e.g., current sensor) for measuring the current of motor, a torque sensor for measuring the torque of motor, a rotational speed sensor, a resolver for measuring motor speed, or some combination thereof. The sensor may be used to determine a pumping efficiency or a sampling efficiency, depending on the location and type of sensor used. The sensor(s) may be located in the pump 60, as shown with reference to sensor 100, sensor 102, and sensor 103. In the illustrated embodiment, the sensors 100, 102 are located in fluid flowpaths of the mud check block 76, which is part of the pump 60. In other embodiments, however, the sensors 100, 102 may be located in one or both of the chambers 72, 73. These sensors 100, 102 may be used to determine an in-stroke efficiency and/or an out-stroke efficiency of the pump 60, as explained in detail below, during a continuous pumping period of the LWD tool 40.

Unlike the sensors 100, 102 located in flowpaths of the pump 60, the sensor 103 may be located in the motor 70 of the pump 60, in order to measure electrical and/or mechanical parameters useful for calculating a pumping efficiency of the pump 60. In certain embodiments, for example, the sensor 103 may be a torque sensor coupled to the motor 70 to measure a torque on the motor 70. In other embodiments, the sensor 103 may be a resolver or some other sensor designed to measure the rotational speed of the motor 70. In still other embodiments, the sensor 103 may include an electrical sensor that measures a current, or any other electrical parameter useful for determining an amount of electrical power used by the motor 70. The sensor 103 may provide a signal representative of an amount of power transferred through the rotating motor 70 for moving the formation fluid through the LWD tool 40. The signal from the sensor 103 may be processed to calculate a pumping efficiency of the LWD tool 40, as described in detail below.

Other sensors used to determine efficiencies of the LWD tool 40 may include a sensor 104 located upstream of the pump 60 (e.g., in a flowpath 106 between the probe 58 and the pump 60). The sensor 104 may facilitate a calculation of the in-stroke efficiency of the pump 60 during a continuous pumping period of the LWD tool 40. Other sensors used to calculate efficiencies of the LWD tool 40 may be located downstream of the pump 60 as well. For example, a sensor 108 may be located downstream of the pump 60 and upstream of the FRV 86, and this sensor 108 may be used to determine the out-stroke efficiency of the pump 60 and/or a sampling efficiency of the LWD tool 40. In some embodiments, there may be one or more sensors (e.g., sensor 110) located in a fluid flowpath of the multi-sample module 56 as well, to determine the sampling efficiency of the LWD tool 40 during a sampling period. The sensor 110 may be located in a flowpath upstream of the valves 84 as shown, or the sensor 110 may be located in the sample bottles 62 themselves. Other combinations, numbers, and/or placements of sensors (e.g., sensors 100, 102, 103, 104, 108, 110) may be possible in order to determine an efficiency of the LWD tool 40 based on the sensor measurements.

The illustrated sensors 100, 102, 103, 104, 108, 110 may each be communicatively coupled with a processor 112 that determines, based on signals received from the coupled sensors, an efficiency of the LWD tool 40. The specific calculations of such efficiencies from a monitored pressure, temperature, flow rate, torque, current, and/or rotational speed are described in detail below. As shown in FIG. 2, the processor 112 may be part of the LWD tool 40. In some embodiments, the processor 112 may be coupled with control circuitry that controls operation of the pump motor 70. This may enable the use of sensor feedback to make dynamic adjustments to the pump 60 based on a calculated efficiency. For example, the calculated efficiency may indicate that during a continuous pumping period, the pump 60 is more efficient in the second half of a stroke of the DU 64 than it is during the first half of the stroke. In response, the processor 112 may send control signals to the motor 70 to actuate the piston faster in the first half so that over the same amount of time the pump 60 operates more efficiently. This may save time during the pumping and sampling operations of the LWD tool 40.

Figure 3:
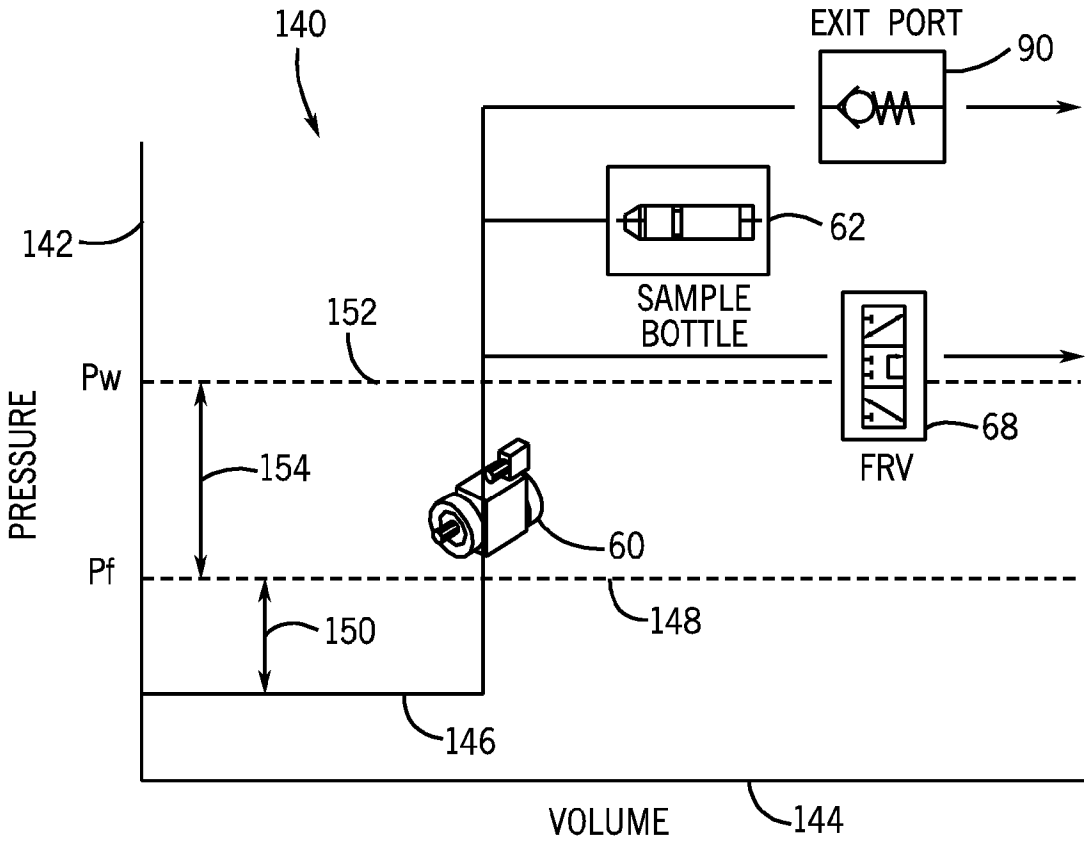
FIG. 3 is a plot of a pressure profile indicative of pumping sampling fluid through the downhole equipment of FIG. 2, in accordance with an embodiment of the present techniques.

FIG. 3 is a plot 140 of a pressure profile indicative of pumping formation fluid through the LWD tool 40 in accordance with present embodiments. The plot 140 illustrates pressure (ordinate 142) of the formation fluid against volume (abscissa 144) of the formation fluid moving through the LWD tool 40. A trace 146 represents the pressure of the formation fluid as it moves through the LWD tool 40. The formation fluid, which is at a formation pressure (Pf) 148, is withdrawn into the flowline 106 via the probe 58 at a drawdown pressure that is lower than Pf 148 (as indicated by a pressure difference 150). As more fluid is drawn in, the formation fluid is brought into the pump 60 and pushed out against a pressure that is greater than a wellbore pressure (Pw) 152 of the well in order to expel the formation fluid via the exit port 90 or FRV 68 or to charge the formation fluid into the sample bottle 62. The plot 140 shows a pressure increase 154 above Pf 148 through which the formation fluid is advanced by the pump 60.

Formation fluid entering through the probe 58 is expanded so that it enters the LWD tool 40 at a lower pressure. As the formation fluid exits the LWD tool 40 (via the FRV 68 or the exit port 90) or is pushed into the sample bottle 62, the formation fluid is compressed by the pump 60 against the higher outlet pressure (i.e. Pw 152). In certain embodiments, the formation fluid may be highly compressible (e.g., gas), and this can lead to inefficiencies in the fluid pumping and/or sampling process. That is, a relatively large amount of energy of the pump 60 may be spent compressing the formation fluid already in the LWD tool 40, instead of moving the formation fluid through the LWD tool 40. Thus, it is desirable to quantify an efficiency of the pumping and/or sampling process of the LWD tool 40 during operation in order to determine when the LWD tool 40 is not effectively moving the formation fluid therethrough. In some embodiments, the monitored efficiency of the LWD tool 40 may be used to determine ways to mitigate inefficient operation of the pump 60.

It is generally useful to collect samples of the formation fluid when the formation fluid drawn in is representative of the actual formation and does not include contaminants (e.g., drilling mud filtrate from the annulus 30). Therefore, it may be desirable for the LWD tool 40 to operate in a continuous pumping mode for some amount of time. Specifically, this entails the pump 60 constantly drawing in the formation fluid and pushing the formation fluid out of the LWD tool 40 into the wellbore via FRV 68 or the exit port 90. No sampling takes place at this time, because the formation fluid that is drawn in may contain an unacceptable amount of contaminants. The LWD tool 40 may operate in this continuous pumping period until an acceptable level of contaminants in the formation fluid is reached. The level of contaminants may be determined based on sensor measurements (e.g., fluid composition) of the formation fluid moving through the LWD tool 40. The continuous pumping period may be referred to as a cleanup period, and it may involve drawing the formation fluid in through the probe 58 and dumping the formation fluid back into the wellbore via the FRV 68 or the exit port 90. When the formation fluid is relatively clean, the LWD tool 40 may switch to the sampling mode (beginning a sampling period of operation). This may include repositioning the FRV 68 to route the formation fluid through the flowline 74 to the multi-sample module 56, and opening the valves 84 to direct the formation fluid into the corresponding sample bottle 62.

Figure 4:
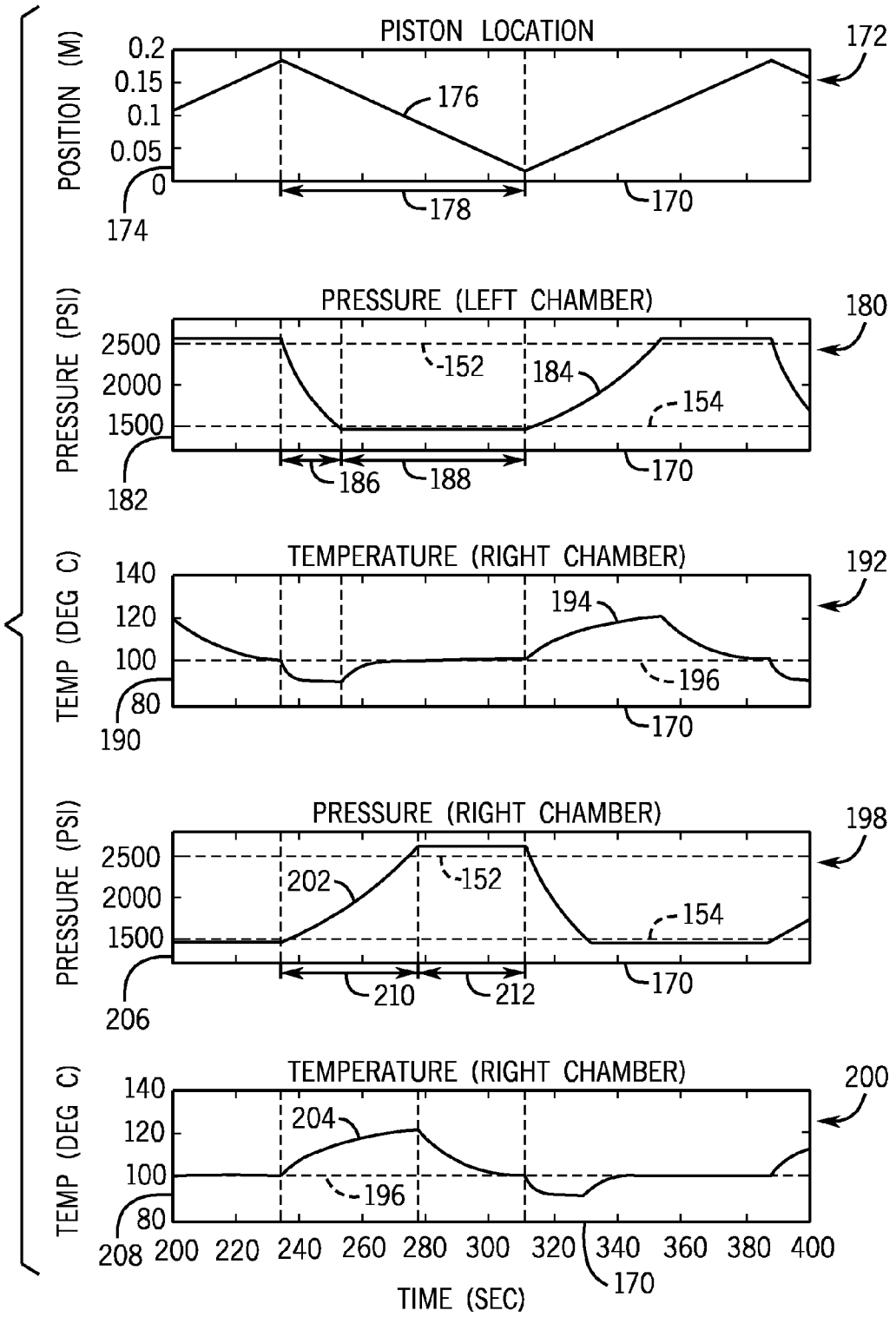
FIG. 4 is a series of subplots representative of sensor signals that may be used to determine a total pumping efficiency of the downhole equipment of FIG. 2, in accordance with an embodiment of the present techniques.

FIG. 4 is a series of subplots representative of sensor signals that may be used to determine a total pumping efficiency of the LWD tool 40 during the continuous pumping period in accordance with present embodiments. Each subplot shows a different sensor signal, taken with respect to time 170, in order to clearly illustrate ways to determine the pumping efficiency using different types and/or placements of the sensors 100, 102. As previously mentioned, these sensors 100, 102 are located in the pump 60 (e.g., in flowlines coupled with the chambers 72, 73).

A first subplot 172 shows a piston position 174 of the DU 64 taken with respect to time 170. A trace 176 represents the relative position of the piston of the DU 64 as it moves back and forth in the pump 60. A stroke interval 178 is illustrated to represent the amount of time that it takes for the pump 60 to complete one full stroke of the piston. For example, the stroke interval 178 may be the amount of time it takes for the piston to move from a far edge of the left chamber 72 to an opposite edge of the right chamber 73. The pumping efficiency may be characterized by a portion of the stroke interval 178 that is spent moving the formation fluid as opposed to merely compressing or decompressing the formation fluid in the LWD tool 40.

A second subplot 180 shows a pressure 182 in the left chamber 72 (e.g., monitored by the sensor 100) with respect to time 170. The pressure, shown as a trace 184, may be monitored via a pressure gauge located in the left chamber 72, or in a flowline of the pump 60 in fluid communication with the left chamber 72. During the stroke interval 178, the trace 184 illustrates a pressure decrease due to fluid expansion in the left chamber 72 from the wellbore pressure 152 to the formation pressure 148. This portion of the stroke interval 178 may be referred to as an expansion interval 186. Once the fluid in the left chamber 72 reaches the formation pressure 148, the remainder (e.g., interval 188) of the stroke interval 178 is used to move additional formation fluid from the probe section 50 into the left chamber 72.

To determine pumping efficiency during a continuous pumping period of the LWD tool 40, the processor 112 may receive data indicative of the illustrated trace 184 as a signal from the sensor 100. Based on the signal received, the processor 112 may then determine an in-stroke efficiency of the pump 60. Specifically, the processor 112 may determine an active duty-cycle in-stroke efficiency according to the following equation:

$$\text{In-stroke active duty-cycle efficiency} = \frac{\text{in-flow fluid interval}}{\text{one-stroke interval}} \times 100\%. \quad (1)$$

In the equation above, in-flow fluid interval refers to the interval 188 illustrated in the subplot 180, and one-stroke interval refers to the stroke interval 178. The in-flow fluid interval may also be calculated by subtracting the interval 186 from the stroke interval 178. The calculated in-stroke efficiency represents the percentage of the stroke interval that is actually moving the formation fluid through the LWD tool 40. The intervals 186 and 188 may be determined based on when the monitored pressure begins to drop from the wellbore pressure 152 and when the monitored pressure reaches the formation pressure 148.

In some embodiments, the sensor 100 in the left chamber 72 may include a thermometer that sends a signal indicative of a temperature 190 of the fluid flowing through the left chamber 72, as shown in a third subplot 192 with a trace 194 that represents the temperature 190 with respect to time 170. At the beginning of the stroke interval, the temperature decreases below a formation temperature 196 due to the expansion of the fluid taking place in the left chamber 72. The decreasing temperature therefore marks the onset of the expansion interval 186. As the formation fluid starts moving through the LWD tool 40, formation fluid entering the left chamber 72 increases the measured temperature toward the formation temperature 196. This marks the onset of the interval 188, which may then be used to determine the in-stroke efficiency according to Equation 1 above.

While formation fluid flows into the left chamber 72 during the stroke interval 178, formation fluid flows out of the right chamber 73 of the pump 60 and toward the FRV 86. The sensor 102 located in fluid communication with the right chamber 73, therefore, may facilitate a calculation of an out-stroke efficiency during the stroke interval 178. This is represented by subplot 198 and subplot 200, which show, respectively, trace 202 and trace 204 representing different monitored parameters that may be utilized to determine the out-stroke efficiency. Specifically, the subplot 198 shows a measurement of pressure 206 in the right chamber 73 taken with respect to time 170 (e.g., via a pressure gauge). Likewise, the subplot 200 shows a measurement of temperature 208 in the right chamber 73 taken with respect to time 170 (e.g., via a thermometer). At the beginning of the stroke interval 178, the pressure increases due to compression of the formation fluid within the right chamber 73. This is shown by a pressure increase of the trace 202 increasing from the formation pressure 148 to the wellbore pressure 152, and by a temperature increase of the trace 204 from the formation temperature 196 to a higher temperature. The processor 112 may determine a compression interval 210 based on one or both of these monitored increases. Once the formation fluid is pressurized to approximately the wellbore pressure 152, the pump 60 pushes the formation fluid out of the right chamber 73 during the remainder of the stroke interval 178. This is evidenced by a relatively constant pressure measurement that is near the wellbore pressure 152 and/or by a gradually decreasing temperature measurement back toward the formation temperature 196. This defines an out-flow interval 212, during which the formation fluid flows out of the right chamber 73. The processor may calculate an out-stroke efficiency of the LWD tool 40 as defined by the following equation:

$$\text{Out-stroke active duty-cycle efficiency} = \frac{\text{out-flow fluid interval}}{\text{one-stroke interval}} \times 100\%. \quad (2)$$

The out-flow fluid interval of Equation 2 corresponds with the determined out-flow interval 212, while the one-stroke interval, as before, corresponds with the stroke interval 178. The processor 112 may determine a total pumping efficiency of the LWD tool 40 during a continuous pumping period by multiplying the calculated in-stroke efficiency by the calculated out-stroke efficiency. Again, the processor 112 may be configured to adjust operations of the pump 60 based on the calculated in-stroke and out-stroke efficiencies, in order to increase the efficiency of the pump throughout the continuous pumping period.

It may be possible to determine both the in-stroke and out-stroke efficiencies, and thus, the total pumping efficiency, based on measurements received from as few as one sensor (e.g., 100 or 102) located in the pump 60. For example, one sensor connected to the left chamber 72 may facilitate a calculation of the in-stroke efficiency during the stroke interval 178, and a calculation of the out-stroke efficiency during the next subsequent stroke of the pump 60. That is, when the DU 64 moves back toward the left chamber 72, forcing the formation fluid out of the left chamber 72, the pressure and/or temperature measurements may be substantially the same as those measured during the out-stroke of the right chamber 73.

Figure 5:
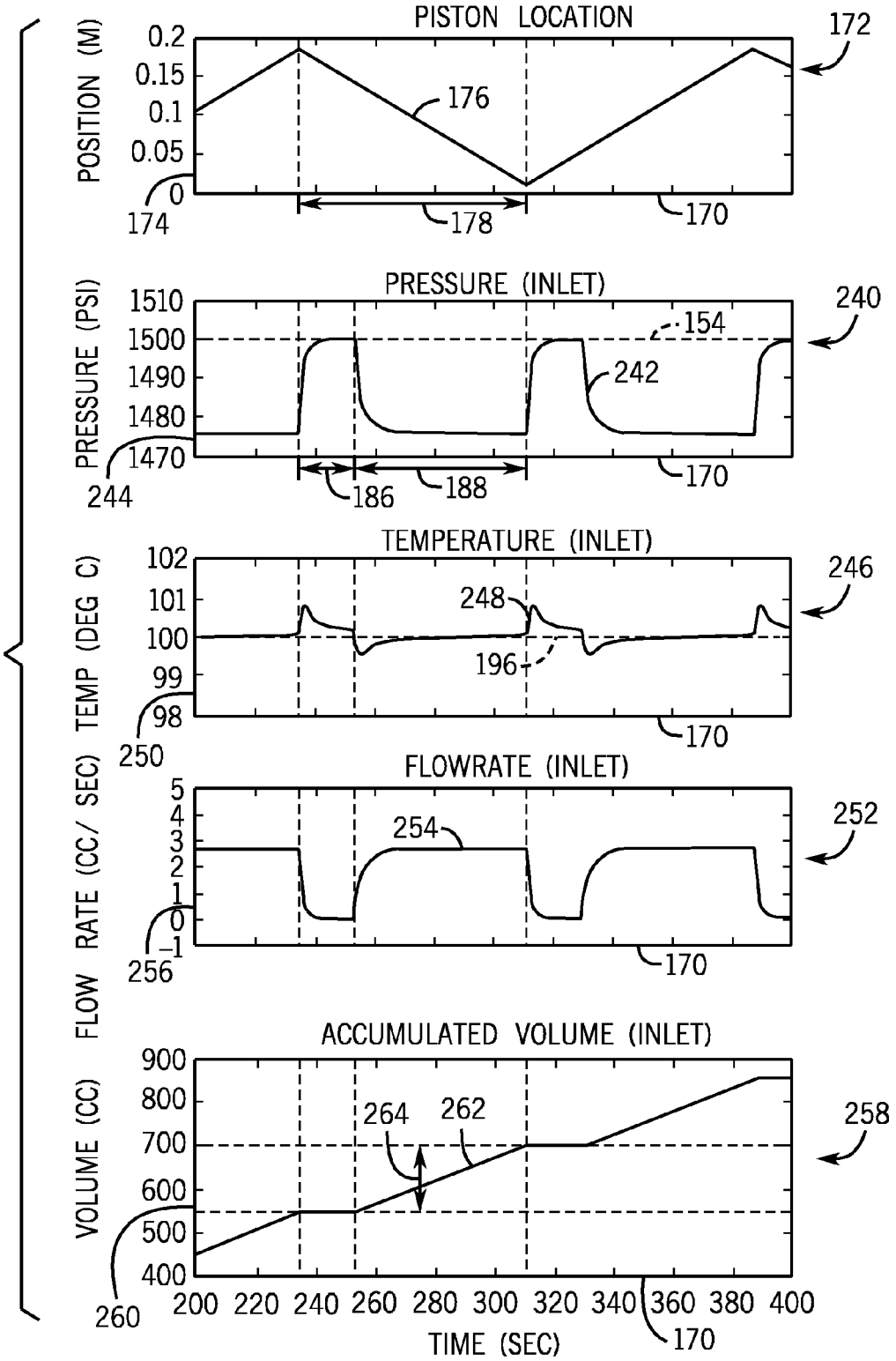
FIG. 5 is a series of subplots representative of sensor signals that may be used to determine an in-stroke efficiency of the downhole equipment of FIG. 2, in accordance with an embodiment of the present techniques.

Other sensors (e.g., sensors 103, 104, 108) may facilitate a calculation of the pumping efficiency during a continuous pumping period of the LWD tool 40. For example, FIG. 5 is a series of subplots representative of signals from the sensor 104 that may be used to determine, via the processor 112, the in-stroke efficiency. The first subplot 172 is the same as the first subplot 172 of FIG. 4, showing the position 174 of the DU 64 over time 170 and the stroke interval 178. A second subplot 240 includes a trace 242 representative of a pressure 244 of the formation fluid taken with respect to time 170 from a location upstream of the pump 60. This trace 242, therefore, is indicative of a signal received from a pressure gauge at the location of sensor 104. Similarly, a third subplot 246 includes a trace 248 representative of a temperature 250 of the formation fluid monitored via a thermometer at the same upstream location. A fourth subplot 252 includes a trace 254 representative of a flow rate 256 of the formation fluid monitored via a flow meter at the same location.

The processor 112 may execute instructions to determine an in-stroke efficiency of the pump 60 based on one or more of these sensor measurements. As before, there is the no-flow interval 186 when the pump 60 is decompressing the formation fluid already held in the pump 60 before drawing in any additional formation fluid from the flowline 106. The one or more sensors 104 may indicate the no-flow interval 186 as the period during which the pressure increases to and remains at the formation pressure 148, a temperature increase above the formation temperature 196, and/or a reduction of the flow rate to zero. Once the formation fluid is moving steadily through the LWD tool 40 (e.g., during the in-flow interval 188), the pressure lowers (e.g., 150) back to a drawdown pressure, the temperature decreases and returns to the formation temperature 196, and the flow rate increases to a constant forward flow rate. In this way, the sensor 104 upstream of the pump 60 may facilitate a calculation of the in-stroke efficiency (according to Equation 1) of the LWD tool 40.

As mentioned above, the sensor 103 may measure an electrical property (e.g., current) or mechanical property (e.g., torque, rotational speed) of the motor 70 providing the pumping power to move the reciprocating piston of the pump 60. As such, the signal sent from the sensor 103 may be similar to the trace 254 showing the flow rate 256 of the formation fluid into the pump 60. At the beginning of the stroke interval 178, there may be a relatively low torque on the motor 70 during the no-flow interval 186. The torque increases once the piston begins moving the formation fluid, and not just compressing the formation fluid, and this may indicate the onset of the interval 188. A similarly noticeable change may occur at the onset of each of the intervals 186, 188 in a signal indicative of a sensed current supplied to the motor 70, or a sensed rotational speed of the motor 70.

A fifth subplot 258 represents an accumulated volume 260 of the formation fluid that passes through the flowline 106 in response to the pump 60. A trace 262 shows that the volume 260 does not change during the no-flow interval 186, but increases at a constant rate during the in-stroke interval 188. The trace 262 may be determined by the processor 112 through an integration of a signal received from the flow meter (e.g., 254). The subplot 258 illustrates an effective volume 264 of formation fluid that is moved through the flowline 106, and thus the LWD tool 40, during the stroke interval 178. The processor 112 may determine an in-stroke volume efficiency of the LWD tool 40 based on the effective volume 264, according to the following equation:

$$\text{In-stroke volume efficiency} = \frac{\Delta V}{\text{one-stroke volume}} \times 100\%. \quad (3)$$

In the above equation, ΔV is the effective volume 264 of formation fluid, as determined by integrating the monitored flow rate. The one-stroke volume is the total volume through which the piston moves during the stroke interval 178, which may be calculated by multiplying the change in piston location by a cross-sectional area of the piston.

Figure 6:
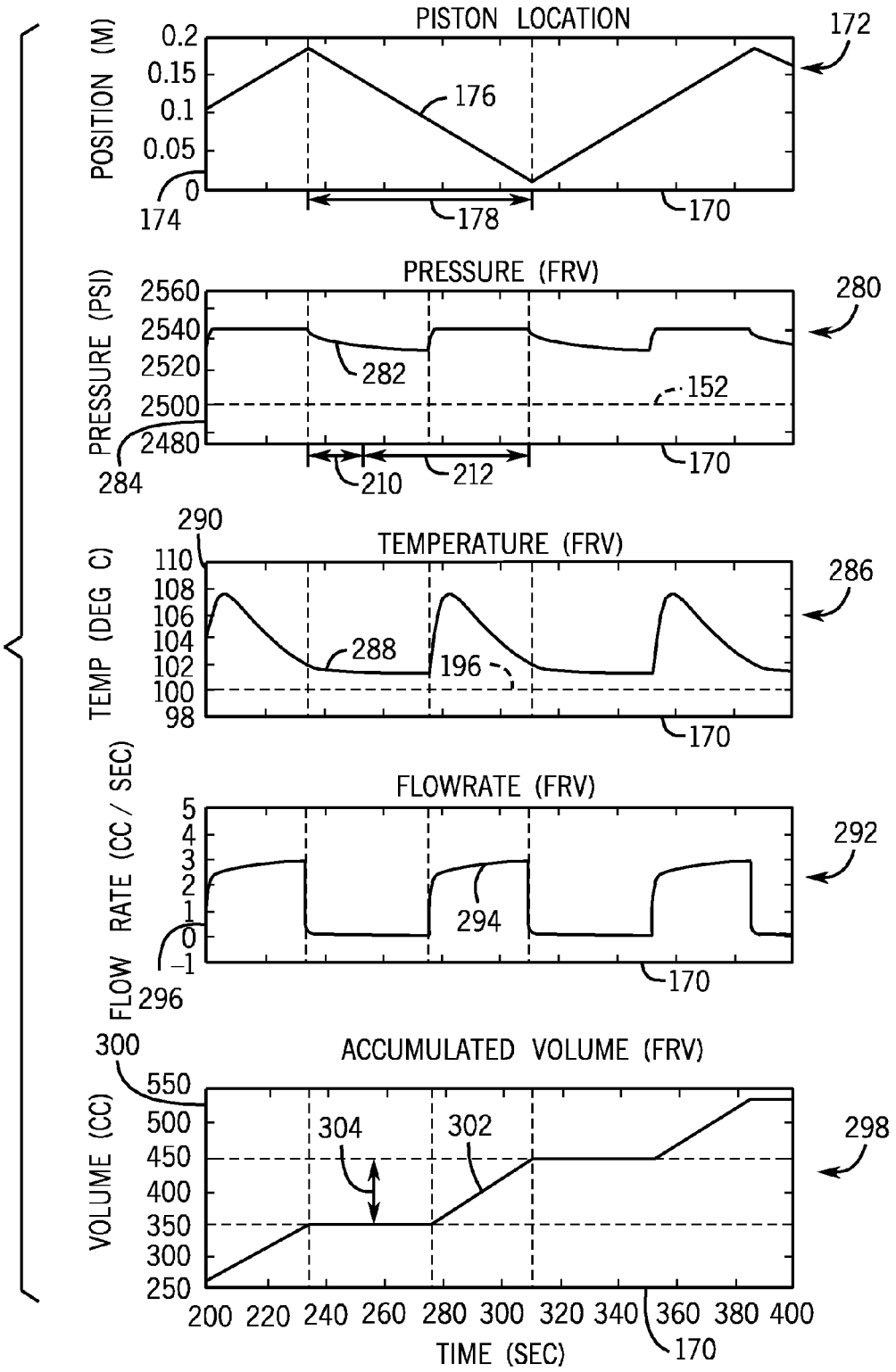
FIG. 6 is a series of subplots representative of sensor signals that may be used to determine an out-stroke efficiency of the downhole equipment of FIG. 2, in accordance with an embodiment of the present techniques.

FIG. 6 is a series of subplots representative of signals from the sensor 108 that may be used to determine, via the processor 112, the out-stroke efficiency. The first subplot 172 is the same as the first subplot 172 of FIG. 4, showing the position 174 of the DU 64 over time 170 and the stroke interval 178. A second subplot 280 includes a trace 282 representative of a pressure 284 of the formation fluid taken with respect to time 170 from a location downstream of the pump 60. This trace 282, therefore, is indicative of a signal received from a pressure gauge at a location of the sensor 108, or any other sensor placed in a flowline downstream of the pump 60. Similarly, a third subplot 286 includes a trace 288 representative of a temperature 290 of the formation fluid monitored via a thermometer at the same downstream location. A fourth subplot 292 includes a trace 294 representative of a flow rate 296 of the formation fluid monitored via a flow meter at the same location.

The processor 112 may determine an out-stroke efficiency of the pump 60 based on one or more of these sensor measurements. As before, there is the compression interval 210 when the pump 60 is compressing the formation fluid already held in the pump 60 before pushing the compressed formation fluid out through the flowline 74. In addition to the pump 60 moving the formation fluid against the wellbore pressure 152, the formation fluid pressure may have to overcome an additional cracking pressure of the FRV 86 before it is expelled into the wellbore. For at least these reasons, the pressure downstream of the pump 60 is maintained generally higher than the wellbore pressure 152. The one or more sensors 108 may indicate the compression interval 210 as a pressure decrease back toward the wellbore pressure 152, a temperature decrease toward the formation temperature 196, and/or a reduction of the flow rate to zero. Once the formation fluid is moving steadily through the LWD tool 40 (e.g., during the out-flow interval 212), the downstream pressure returns to a higher pressure, the temperature increases to higher than the formation temperature 196, and the flow rate increases to a constant forward flow rate. In this way, the sensor 108 downstream of the pump 60 may facilitate a calculation of the out-stroke efficiency (according to Equation 2) of the LWD tool 40.

A fifth subplot 298 represents an accumulated volume 300 of the formation fluid that passes through the flowline 74 in response to the pump 60. A trace 302, which is representative of the accumulated volume 300 with respect to time 170, shows that the volume 300 does not change during the compression interval 210, but increases at a constant rate during the out-stroke interval 212. This trace 302 may be determined by the processor 112 through an integration of a signal received from the flow meter (e.g., 294). The subplot 298 illustrates an effective volume 304 of formation fluid that is moved through the flowline 74, and thus the LWD tool 40, during the stroke interval 178. The processor 112 may determine an out-stroke volume efficiency of the LWD tool 40 based on the effective volume 304 (ΔV), according to the following equation:

$$\text{Out-stroke volume efficiency} = \frac{\Delta V}{\text{one-stroke volume}} \times 100\%. \quad (4)$$

In addition to determining the pumping efficiency of the LWD tool 40 during a continuous pumping period, at least one sensor (e.g., 108, 110) may facilitate calculation of a sampling efficiency of the LWD tool 40. Sampling efficiency may be calculated during a sampling period, which is initiated through the opening of one of the valves 64 to the sample bottles 62 once the formation fluid is determined to be clean. Depending on the compressibility of the formation fluid, it may take several strokes of the pump 60 to fill up one of the sample bottles 62. The sensors 108 or 110 placed in flowlines between the pump 60 and the sample bottles 62 may monitor properties of the formation fluid used for calculating a sampling efficiency of the LWD tool 40 once the valve 64 is opened, as well as when the bottle 62 is filled up and ready to be closed.

Figure 7:
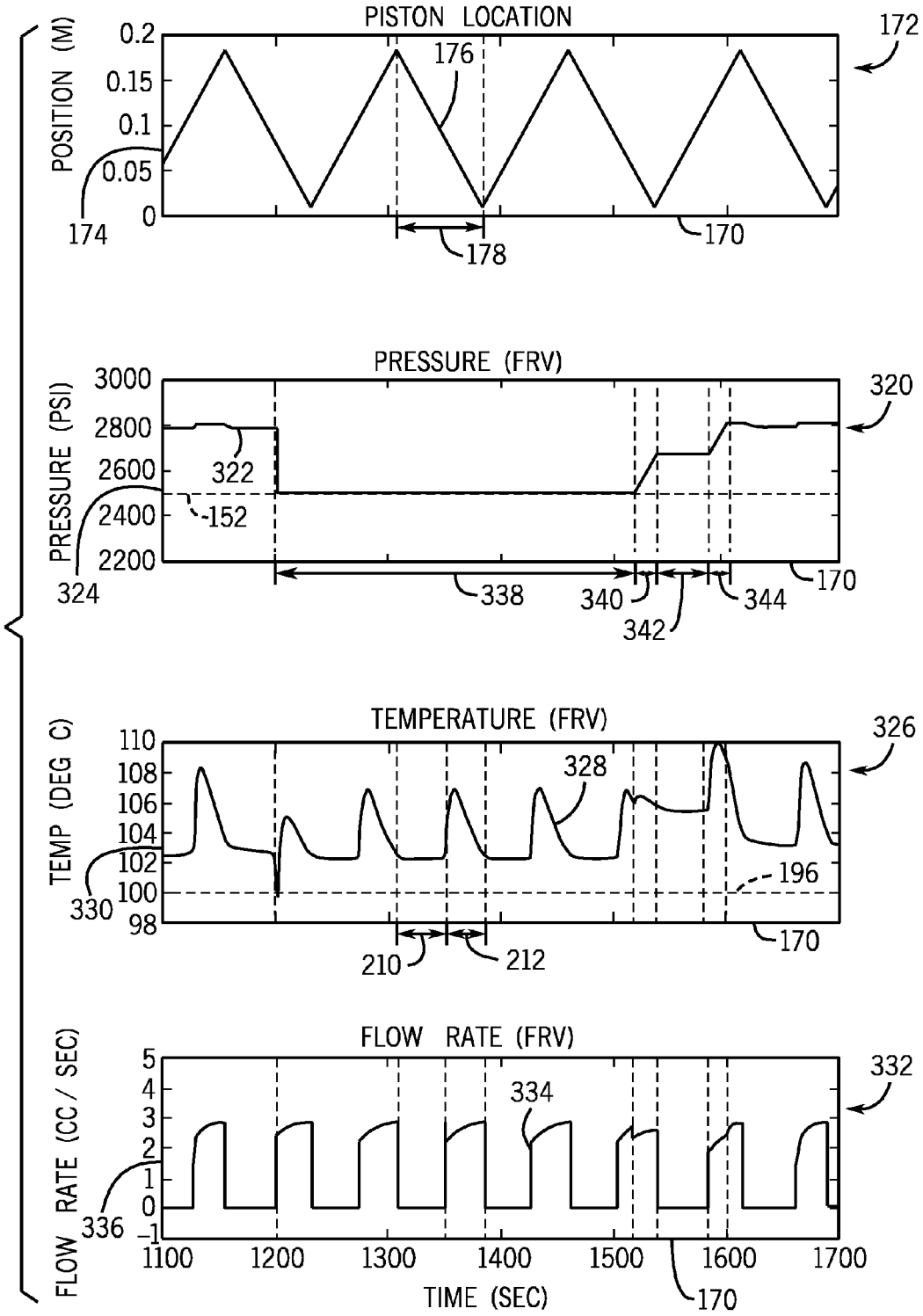
FIG. 7 is a series of subplots representative of sensor signals that may be used to determine a sampling efficiency of the downhole equipment of FIG. 2, in accordance with an embodiment of the present techniques.

FIG. 7 is a series of subplots representative of signals from the sensor 108 that may be used to determine, via the processor 112, the sampling efficiency of the LWD tool 40 during a sampling period. The first subplot 172 is the same as the first subplot 172 of FIG. 4, although taken over a longer period of time, showing the position 174 of the DU 64 over time 170 and a stroke interval 178. A second subplot 320 includes a trace 322 representative of a pressure 324 of the formation fluid taken with respect to time 170 from a location downstream of the pump 60 and upstream of the FRV 68. This trace 322, therefore, is indicative of a signal received from a pressure gauge at a location of the sensor 108 during a sampling period. Similarly, a third subplot 326 includes a trace 328 representative of a temperature 330 of the formation fluid monitored via a thermometer at the same location. A fourth subplot 332 includes a trace 334 representative of a flow rate 336 of the formation fluid monitored via a flow meter at the same location.

In the subplots 320, 326, 332, the sampling period begins approximately at the time (170) of 1200 seconds. Shortly after the valve 64 is opened to charge the fluid into the sample bottle, the measured pressure 324 drops to the wellbore pressure 152 and stays at this pressure for a fill interval 338 until the sample bottle 62 is entirely filled with the formation fluid. After the sample bottle 62 is filled, a remainder of the stroke (flow interval 340) increases the pressure in the sample bottle above the wellbore pressure 152. At this point, another stroke interval 178 begins, first compressing the formation fluid in the pump 60, so that the sensor 108 reads a constant pressure for a compression interval 342. Once the outlet pressure is reached by the formation fluid in the pump 60, the pressure increases further during another flow interval 344. This may continue until the pressure reaches a relief pressure of the exit port 90, so that the formation fluid then exits the LWD tool 40 via the exit port 90. If the sample bottle 62 is closed at the end of the fill interval 338, the pressure of the formation fluid sample in the bottle 62 is maintained at the wellbore pressure 152. Likewise, if the sample bottle 62 is closed at the end of the flow interval 344, the pressure of the formation fluid sample in the bottle 62 is maintained at a pressure higher than the wellbore pressure 152.

The third subplot 326 shows substantially similar temperature fluctuations to those shown in FIG. 6, indicating the compression interval 210 and the out-flow interval 212. In this way, the sensor 108 may facilitate calculation of an out-stroke efficiency even during the sampling period of the LWD tool 40. Certain fluctuations in the measured temperature 330 also may indicate the fill interval 338 and other intervals 340, 342, and 344 used to determine a sampling efficiency. The third subplot 332 shows the flow rate 336 measured by the sensor 108 during sampling. Certain fluctuations in the flow rate 336 may indicate the intervals 338, 340, 342, 344 as well. In calculating the sampling efficiency, the intervals where there is no formation fluid flowing through the flowline 74 are indicative of inefficiencies in the formation fluid sampling.

Figure 8:
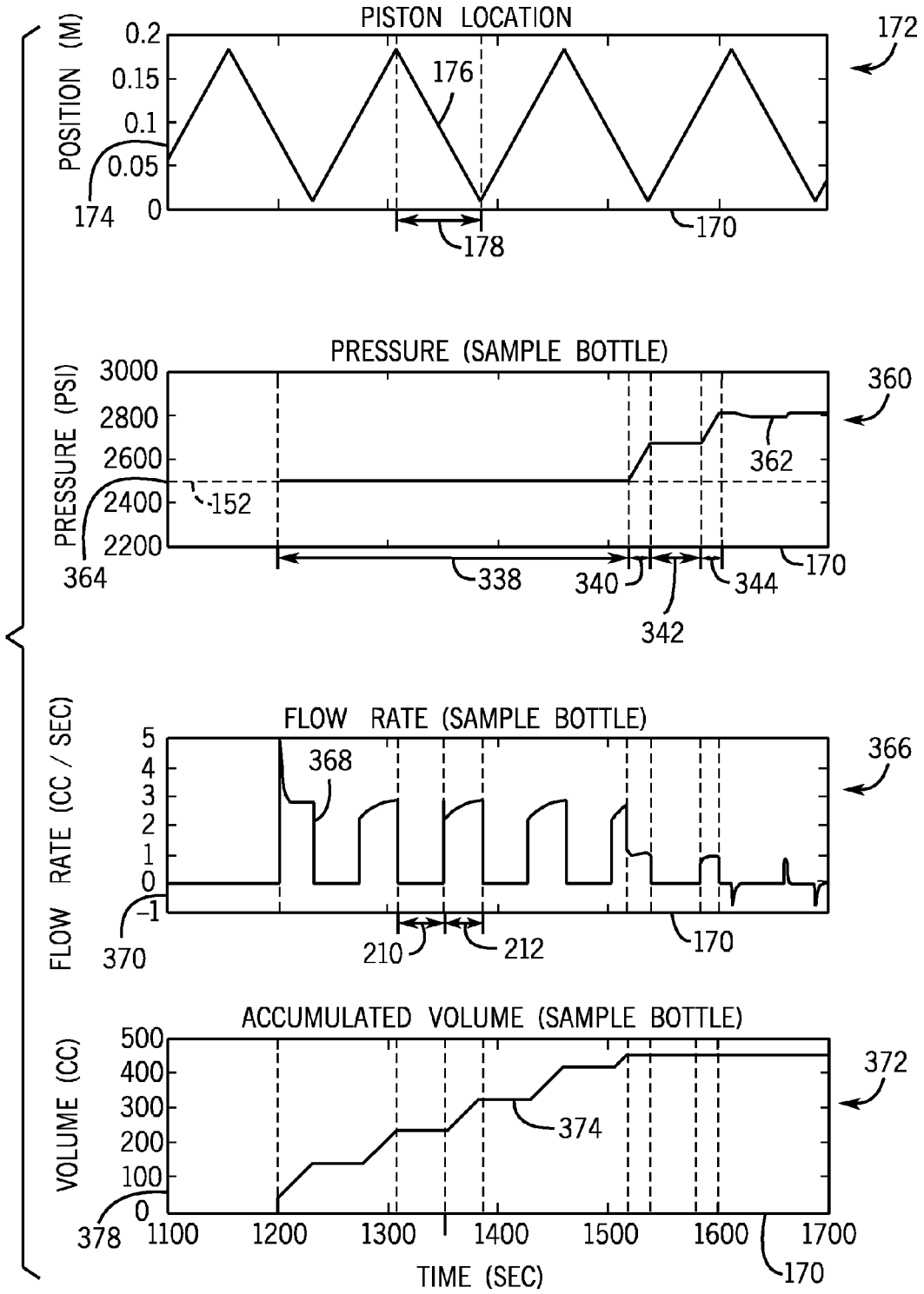
FIG. 8 is a series of subplots representative of sensor signals that may be used to determine a sampling efficiency of the downhole equipment of FIG. 2, in accordance with an embodiment of the present techniques.

FIG. 8 is a series of subplots representative of signals from the sensor 110 that may be used to determine, via the processor 112, the sampling efficiency of the LWD tool 40 during the sampling period. The first subplot 172 is the same as the first subplot 172 of FIG. 7, showing the position 174 of the DU 64 over time 170 and the stroke interval 178. A second subplot 360 includes a trace 362 representative of a pressure 364 of the formation fluid taken with respect to time 170 from a location in or just upstream of the sample bottles 62. This trace 362, therefore, is indicative of a signal received from a pressure gauge at a location of the sensor 110 during a sampling period. Similarly, a third subplot 366 includes a trace 368 representative of a flow rate 370 of the formation fluid monitored via a flow meter at the same location. A fourth subplot 372 includes a trace 374 representing an integration of the monitored flow rate (368) performed by the processor, to give a volume 378 of the formation fluid flowing past the sensor 110 into the sample bottle 62.

The trace 362 of the pressure 364 at the location of sensor 110 is substantially similar to the trace 322 of the pressure 324 at the location of sensor 108 during the sampling period. In addition, the intervals (e.g., 210) of no fluid flow in the third subplot 366 are generally identical to those intervals of no fluid flow in the third subplot 332 of FIG. 7. The fourth subplot 372 shows the accumulated volume of formation fluid over the sampling period, which may provide a status (e.g., percentage) of the sample bottle 62 that is filled during the sampling period.

The signals shown in FIGS. 7 and 8 may provide the basis for sampling efficiency calculations performed by the processor 112. For example, the processor 112 may determine a sampling efficiency of the LWD tool 40 during a sampling period according to the following equation:

$$\text{Sampling efficiency} = \frac{\text{\# of strokes whose stroke volume equal to sample bottle volume}}{\text{\# of strokes needed to fill up sample bottle}} \times 100\%. \quad (5)$$

The denominator of Equation 5 may be the number of strokes needed to fill the sample bottle 62 if the sampled formation fluid were incompressible. The numerator may indicate the number of strokes needed to fill the sample bottle 62 to a desired pressure equal to or greater than the wellbore pressure 152. In this way, the sampling efficiency is somewhat similar to the volume efficiency described above. In other embodiments, the sampling efficiency may be determined based on the proportion of no-flow intervals and flow intervals relative to the entire stroke interval 178, as determined based on the monitored flow rates 336 or 370.

Figure 9:
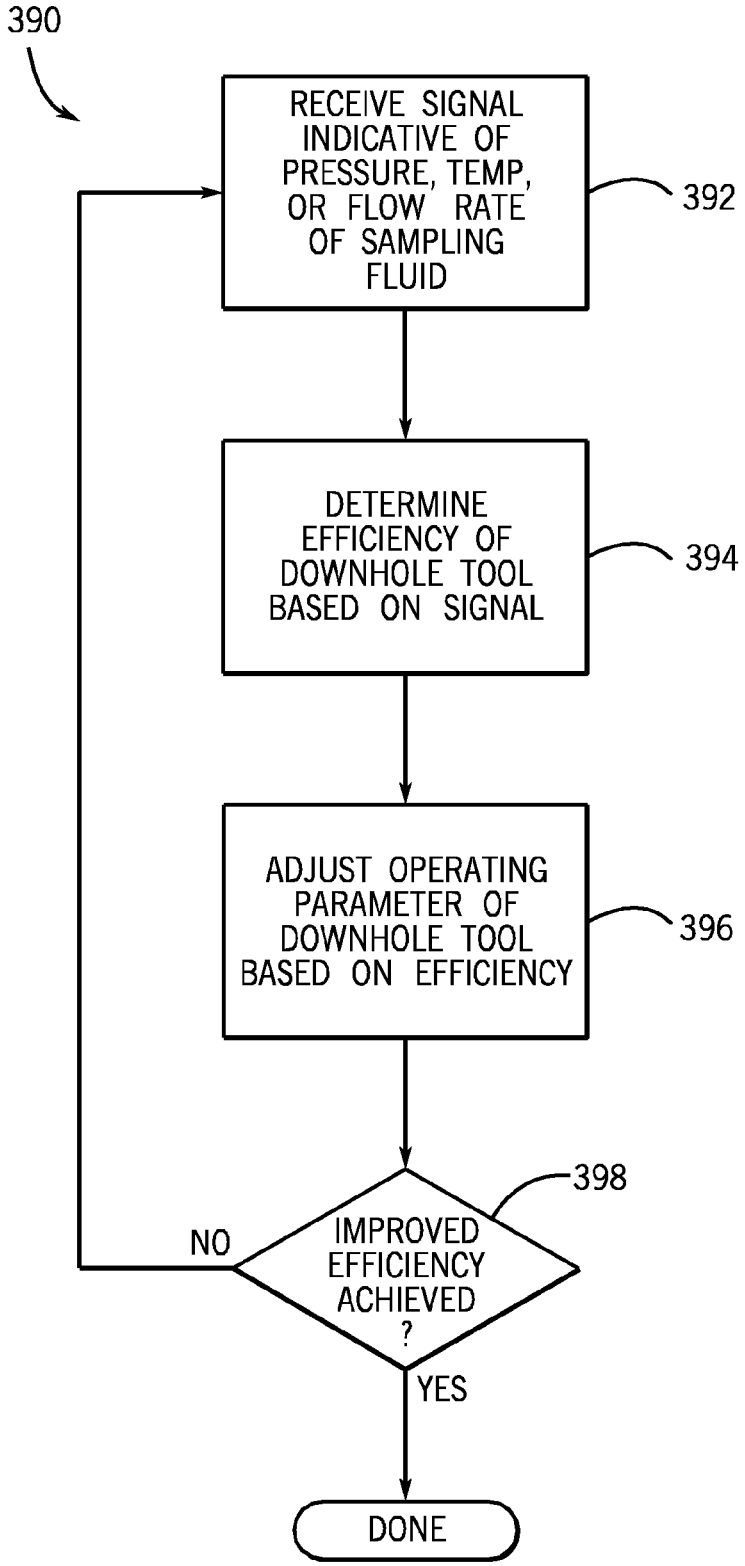
FIG. 9 is a process flow diagram of a method for determining an efficiency of the downhole equipment of FIG. 2, in accordance with an embodiment of the present techniques.

FIG. 9 is a process flow diagram of an embodiment of a method 390 for determining an efficiency of the LWD tool 40. The method 390 includes receiving (block 392), via the processor 112, a signal indicative of a pressure, a temperature, or a flow rate of the sampling formation fluid through a fluid flow path of the LWD tool 40. The fluid flow path may include the pump 60, the upstream flowpath 106, the downstream flowpath 74, or the sample bottles 62, depending on a position of the sensor (e.g., 100, 102, 104, 108, 110) providing the signal. The method 390 also includes determining (block 394), via the processor 112, an efficiency of the LWD tool 40 in facilitating a flow of the sampling fluid through the LWD tool 40 based on the received signal. This determination may be made with an onboard or offboard processor according to any of the techniques described with respect to FIGS. 4-8. The determined efficiency may include an in-stroke efficiency of the formation fluid flowing into the pump 60, or an out-stroke efficiency of the formation fluid flowing out of the pump 60. The determined efficiency may include a total pumping efficiency of the LWD tool 40 determined based on the calculated in-stroke and out-stroke efficiencies. In some embodiments, the method 390 may include determining a sampling efficiency of the downhole tool during a sampling period, as described with respect to FIGS. 7 and 8. In the illustrated embodiment, the method 390 also includes adjusting (block 396) an operating parameter of the LWD tool 40 based on the determined efficiency. Such an adjustment may include changing a speed of the motor 70 actuating the pump 60, in order to improve an efficiency of the pump operation. Other adjustments to the downhole tool operation may be possible based on the determined efficiency. This may involve determining (block 398) whether an improved efficiency is achieved once the adjustment is made. In this way, the LWD tool 40 may be adjusted until the calculated efficiency of the LWD tool 40 reaches a satisfactory level. In some embodiments, the processor 112 may communicate the efficiency to a processor at the surface 16 of the well, and this processor may initiate adjustments to other parameters (e.g., a depth of the LWD tool 40).

The method 390 and systems described above enable determination of efficiency of formation fluid sampling operations by a downhole tool, so that appropriate action may be taken when the operation is determined to be inefficient. This may save rig-time during extraction of formation fluid samples and various drilling operations. In addition, the monitored parameters (e.g., sensor outputs and calculated efficiencies) may be transmitted to surface equipment for real-time viewing and evaluation, so that drilling operators are aware of the performance of the downhole equipment during pumping and sampling operations.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

What is claimed is:

1. A downhole tool, comprising:

a pump configured to facilitate a flow of sampling fluid through the downhole tool, from an inlet of the downhole tool toward an outlet of the downhole tool or to a sampling chamber; and at least one sensor disposed in the downhole tool and configured to facilitate calculation, by a processor communicatively coupled with the at least one sensor, of a sampling efficiency of the downhole tool during a sampling period, wherein the sampling efficiency is calculated by dividing a first number of pump strokes to fill the sampling chamber with the sampling fluid by a second number of pump strokes to fill the sampling chamber if the sampling fluid were incompressible.

2. The downhole tool of claim 1, wherein the pump comprises a motor configured to actuate a displacement unit of the pump, and wherein the at least one sensor is coupled to the motor.

3. The downhole tool of claim 1, wherein the at least one sensor comprises at least one of a pressure gauge, a flow meter, a thermometer, a rotational speed sensor, a torque sensor, or a current sensor.

4. The downhole tool of claim 1, wherein the at least one sensor is configured to facilitate calculation, by the processor communicatively coupled with the at least one sensor, of an in-stroke efficiency and an out-stroke efficiency of the pump during a continuous pumping period.

5. The downhole tool of claim 4, wherein the processor is configured to determine a total pumping efficiency by multiplying the in-stroke efficiency by the out-stroke efficiency.

6. The downhole tool of claim 1, wherein the at least one sensor is disposed downstream of the pump or in the sampling chamber.

7. The downhole tool of claim 1, comprising a fluid routing valve positioned downstream of the pump and configured to direct the sampling fluid toward the outlet in a first valve position and toward the sampling chamber in a second valve position, wherein the at least one sensor is disposed upstream of the fluid routing valve to facilitate calculation, by the processor, of an out-stroke efficiency of the downhole tool during a continuous pumping period.

8. The downhole tool of claim 1, wherein the at least one sensor is disposed upstream of the pump to facilitate calculation, by the processor communicatively coupled with the at least one sensor, of an in-stroke efficiency of the downhole tool during a continuous pumping period.

9. A system, comprising:

a downhole tool comprising at least one sensor and configured to receive sampling fluid from a well formation; and a processor configured to receive a signal from the at least one sensor, the signal being indicative of a pressure, flow rate, temperature, torque, rotational speed, or current; wherein the processor is configured to determine, based on the signal, an in-stroke efficiency and an out-stroke efficiency of the pump during a continuous pumping period, and a total pumping efficiency by multiplying the in-stroke efficiency by the out-stroke efficiency.

10. The system of claim 9, wherein the processor is disposed in the downhole tool.

11. The system of claim 9, wherein the at least one sensor is disposed in a flowpath of the pump of the downhole tool, wherein the pump is configured to facilitate the flow of the sampling fluid through the downhole tool.

12. The system of claim 9, wherein the at least one sensor is coupled to a motor of the pump of the downhole tool, wherein the pump is configured to facilitate the flow of the sampling fluid through the downhole tool.

13. The system of claim 9, wherein the at least one sensor is disposed upstream of the pump or downstream of the pump, wherein the pump is configured to facilitate the flow of the sampling fluid through the downhole tool.

14. The system of claim 9, wherein the processor is configured to determine a sampling efficiency of the downhole tool during a sampling period, and the at least one sensor is disposed downstream of a pump of the downhole tool.

15. The system of claim 9, wherein the processor is configured to provide a signal for adjusting operation of the downhole tool based on at least one of the determined in-stroke efficiency, the out-stroke efficiency, or the total pumping efficiency, or any combination thereof, of the downhole tool.

16. A method, comprising:

receiving, via a processor, a signal indicative of a sensed parameter of a downhole tool configured to receive and collect samples of a formation fluid; and determining, via the processor, an active duty-cycle efficiency of the downhole tool in facilitating a flow of the formation fluid through the downhole tool based on the received signal, wherein the active duty-cycle efficiency is determined by dividing an in-flow fluid interval by a one-stroke interval or by dividing an out-flow fluid interval by the one-stroke interval.

17. The method of claim 16, comprising adjusting an operating parameter of the downhole tool based on the determined active duty-cycle efficiency of the downhole tool.

* * * * *